US009487709B2

(12) United States Patent
Reinke et al.

(10) Patent No.: US 9,487,709 B2
(45) Date of Patent: Nov. 8, 2016

(54) REDUCTION OF BYPRODUCT-GAS EMISSIONS FROM A COKING-OVEN CHAMBERS

(75) Inventors: Martin Reinke, Dortmund (DE); Holger Thielert, Dortmund (DE); Rainer Worberg, Bottrop (DE)

(73) Assignee: THYSSENKRUPP UHDE GMBH, Dortmund (DE)

( * ) Notice: Subject to any disclaimer, the term of this patent is extended or adjusted under 35 U.S.C. 154(b) by 582 days.

(21) Appl. No.: 14/000,208

(22) PCT Filed: Feb. 8, 2012

(86) PCT No.: PCT/EP2012/052132

§ 371 (c)(1),
(2), (4) Date: Oct. 28, 2013

(87) PCT Pub. No.: WO2012/110380

PCT Pub. Date: Aug. 23, 2012

(65) Prior Publication Data

US 2014/0048403 A1 Feb. 20, 2014

(30) Foreign Application Priority Data

Feb. 16, 2011 (DE) ..... 10 2011 000 770

(51) Int. Cl.
*C10B 27/04* (2006.01)
*C10B 31/10* (2006.01)

(52) U.S. Cl.
CPC ..... *C10B 27/04* (2013.01); *C10B 31/10* (2013.01)

(58) Field of Classification Search
CPC ..... C10B 27/04; C10B 31/10
USPC ..... 201/27, 40; 202/263, 255, 256, 257, 202/258
See application file for complete search history.

(56) References Cited

U.S. PATENT DOCUMENTS 3,956,073 A * 5/1976 Carbone ..... C10B 27/04 202/254
4,100,033 A * 7/1978 Holter ..... C10B 27/04 202/263
4,244,785 A * 1/1981 Alderman ..... C10B 27/00 202/263

(Continued)

FOREIGN PATENT DOCUMENTS

DE 2800011 A 7/1979
DE 3329367 A 11/1984

(Continued)

OTHER PUBLICATIONS

Machine translation of DE 3927758 (Aug. 1991).*

*Primary Examiner* — Jill Warden
*Assistant Examiner* — Joye L Woodard
(74) *Attorney, Agent, or Firm* — Andrew Wilford

(57) ABSTRACT

The invention relates to a method of reducing emissions of byproduct gas when charging oven chambers of a battery of coking ovens, on the proviso that the oven chamber (1) to be charged is opened on the machine side (MS) of the battery of coking ovens, and a block of compressed coal (10) is introduced into the opened oven chamber (1). Byproduct gases released during introduction of the block of compressed coal (10) into the hot oven chamber (1), are discharged through a byproduct-gas manifold (11) attached to the oven chamber (1) and are then preferably freed of dust and incinerated. Crude gases formed in the closed oven chambers during coking are discharged through a crude-gas manifold (3) attached to the oven chambers (1) and are passed on for treatment by at least one gas scrubber. According to the invention, conduits connecting the crude-gas manifold (3) and the byproduct-gas manifold (11) to the oven chambers (1) are alternately opened and closed such that the byproduct gases that form during the charging of the oven chambers (1) are admitted only into the byproduct-gas manifold (11), and that the crude gases that form during coking in the closed oven chambers are fed only into the crude-gas manifold (3).

18 Claims, 2 Drawing Sheets

(56) References Cited

U.S. PATENT DOCUMENTS

| | | | | |
|---|---|---|---|---|
| 4,663,134 | A * | 5/1987 | Laufhutte | C10K 1/12 423/220 |
| 7,094,321 | B2 * | 8/2006 | Krebber | C10B 27/06 202/256 |

FOREIGN PATENT DOCUMENTS

| | | | |
|---|---|---|---|
| DE | 3927758 | A | 8/1991 |
| GB | 1387962 | A | 3/1975 |

* cited by examiner

REDUCTION OF BYPRODUCT-GAS EMISSIONS FROM A COKING-OVEN CHAMBERS

CROSS REFERENCE TO RELATED APPLICATIONS

This application is the US-national stage of PCT application PCT/EP2012/052132 filed 8 Feb. 2012 and claiming the priority of German patent application 102011000770.9 itself filed 16 Feb. 2011.

CROSS REFERENCE TO RELATED APPLICATIONS

This application is the US-national stage of PCT application PCT/EP2012/052132 filed 8 Feb. 2012 and claiming the priority of German patent application 102011000770.9 itself filed 16 Feb. 2011.

FIELD OF THE INVENTION

The invention relates to a method of reducing byproduct-gas emissions when charging oven chambers of a battery of coking ovens with blocks of compressed coal.

BACKGROUND OF THE INVENTION

One special issue when operating a battery of coking ovens having oven chambers that are charged with compressed-coal blocks lies in the fact that, for charging, the oven chamber must be open on the machine side of the battery of coking ovens. While charging compressed-coal blocks into the oven chamber that has a temperature of about 1000° C. so-called byproduct gases that contain unhealthy components form spontaneously. Unless suitable countermeasures are implemented, with each opening of the oven chamber, an intolerable environmental problem is created.

In practical applications, it has been tried to resolve the above-described problem by aspirating a part of the byproduct gases into a crude-gas manifold connected to the oven chambers. This concept provides that, first, a part of the byproduct gases is supplied to a gas-treatment system together with the crude gases generated during the coking process inside the closed oven chambers, the gas-treatment system comprising at least one gas scrubber. The action of drawing off byproduct gases from the opened oven chamber can be effected by bypass pipes used for routing the incident byproduct gases into one of the neighboring oven chambers, and from there they reach the crude-gas manifold. However, practical experience has shown that the described measures are not useful for ensuring compliance with tightened environmental requirements.

The pressure inside the oven chambers of batteries of coking ovens with so-called bulk operation, having oven chambers that are filled with coal from above and through filling openings in the ceiling of the oven, is at times controlled individually, the crude-gas manifold of the battery of coking ovens being operated at a slight partial vacuum. When filling the oven chambers, the partial vacuum of the crude-gas manifold is used to draw off any byproduct gases that form and supply them to the gas treatment means. Insofar as this method is transferred to batteries of coke ovens where the oven chambers are charged with compressed-coal blocks, though it is possible to reduce visible emissions when charging the oven chambers, this operation results, however, in impermissibly high oxygen concentrations in the crude gas. There is no shortage of attempts to shield the openings on the oven chambers during the charging operation with hoods in order to minimize entry of environmental air into the system. However, these efforts have been without success. The air that gets in during the suction operation through the opened oven chamber can cause the automatic deactivation of the fine tar separator operating electrostatically. Moreover, proof has been found to indicate that reactions of oxygen with other components of the crude gas result in the formation of chemical compounds deposit in the pipes of systems downstream, thereby considerably restricting the use of the coke-oven gases produced during the coking operation for heating typical industrial furnaces and/or rendering their use impossible altogether. A further disadvantage that results from any intensive aspiration of the byproduct gases in the crude gas system is the fact that, due to so-called "carry-over," it is possible for fine particles to enter the crude gas during the filling operation and collect in containers and the piping systems of the gas-treatment system producing a negative influence on the quality of the tar that is obtained from the gas treatment.

DE 2 238 372 [GB 1,387,962] relates to batteries of coking ovens with oven chambers that are filled from above with coal through fill openings in the oven ceiling. The oven chambers can be optionally connected to two manifolds, one manifold serving for drawing off the production gas and the other for aspirating the byproduct gases. Dust is removed from the suctioned-off byproduct gases inside a gas scrubber, and the gas is cleaned of any tar components.

OBJECTS OF THE INVENTION

In view of this background, it is the object of the present invention to provide an effective method of reducing byproduct-gas emissions when charging the oven chambers of a battery of coking ovens with compressed-coal blocks. On the one hand, the method must completely aspirate, in as much as this is possible, the byproduct gases generated when introducing the compressed-coal blocks, so that they do not escape through the open door on the machine side into the atmosphere; on the other hand, the method must ensure, simultaneously, that no oxygen enters, in as much as this is possible, into the crude-gas manifold and mixes with the coke-oven gas.

SUMMARY OF THE INVENTION

The present invention and solution of the task at hand provides for a method that presupposes that the oven chamber, which is to be charged with coal, is opened on the machine side of the battery of coking ovens and that compressed-coal blocks are inserted into the opened oven chamber. Any byproduct gases that are released while the compressed-coal blocks are being inserted into the hot oven chambers, are discharged according to the invention through a byproduct-gas manifold that is connected to the oven chamber and, preferably, subsequently freed of dust and burnt. Crude gases that form during a coking process inside the closed oven chambers are discharged through a crude-gas manifold connected to the oven chambers and supplied to a gas-treatment system having at least one gas scrubber. The components of the crude gas that are separated during scrubbing can be processed further into other byproducts. According to the invention, conduits that link the crude gas and byproduct-gas manifolds to the oven chambers are alternately opened and closed so that the byproduct gases generated on charging the oven chambers only go to the byproduct-gas manifold, and the coking-induced crude gases formed inside the closed oven chambers go only to the crude-gas manifold.

The core of the method according to the invention is based on the combination of a conventional crude-gas manifold for discharging crude gases formed by the coking process and a separate byproduct-gas manifold, which serves exclusively for aspirating the byproduct gases, without transfer of them to the gas-treatment system for the crude gas. The pressure inside the byproduct-gas manifold is preferably controlled so the aspirating action can be adapted to the local conditions. Since the byproduct gases are not subjected to any gas treatment that generates byproducts, any oxygen drawn into the byproduct gases is harmless. Preferably, the byproduct gases are completely incinerated and then sent to a stationary dust removal apparatus. To this end, it is possible to employ a separate dust removal unit or, if necessary, an available stationary dust removal apparatus for detecting emissions that are generated during the pushing of coke. The combined use of a stationary dust removal apparatus for removing the dust from emissions that are generated by pushing out the coke, on the one hand, and for removing the dust from the byproduct gases, on the other hand, does not result in any operationally related technical complications because setting of the compressed-coal blocks and the pushing of the coke can be implemented by the same machine at different stages of the process.

Several options are available for the configuration and operation of the byproduct-gas manifold. The byproduct-gas manifold for aspirating the byproduct gases can be connected to a byproduct-gas aspirating car able to travel along the battery of coke ovens. The byproduct-gas aspirating car may have a combustion chamber, and is docked to the oven chamber that must be charged with compressed-coal blocks. Moreover, the byproduct-gas aspirating car can optionally have a device for removing the dust from the byproduct gases. Blocking dampers or slides with temperature-resistant closure elements or locking devices using water-immersion, actuated from the outside, can be used for closing the conduits linking the oven chambers with the byproduct-gas manifold.

The scope of the invention further provides that the byproduct-gas manifold extends as a collecting pipe along the battery of coke ovens, and is connected by conduits to a locking device on the oven chambers of the battery of coke ovens. The flow blockers are blocking dampers or slides with temperature-resistant closure elements or water-immersion that can be opened and closed from the outside.

It is effective for the pressure inside the closed coke oven chambers to be controlled individually during the coking process. The crude-gas manifold can extend as a collecting pipe along the battery of coke ovens and is connected by conduits with respective flow blockers to the oven chambers of the battery of coke ovens. The flow blockers preferably have a dip cup filled with water, as well as a dip pipe that is connected to the gas-carrying conduit. The liquid level is controlled inside the dip cup to open or block the gas path. Using these devices, it is also possible to control the pressure inside each oven chamber. Control organs for maintaining certain pressure levels inside the oven chambers can also be made of temperature-resistant elements with and without water-immersion.

The crude-gas manifold and the byproduct-gas manifold can be installed and operated on the same side or on different sides of the battery of coke ovens. In many existing coke-oven batteries, the crude-gas manifold is on the machine side of the battery of coke ovens. It makes sense then to install and operate the byproduct-gas manifold on the other side, meaning the coke side, of the battery of coke ovens. It is understood that an arrangement that is a mirror image of the above is possible as well.

The subject-matter of the present invention also refers to an effective battery of coke ovens for implementing the described method according to the invention.

BRIEF DESCRIPTION OF THE DRAWING

To illustrate, the invention will be described in further detail below on the basis of a single embodiment. Shown are as follows by way of schematic representations.

SPECIFIC DESCRIPTION OF THE INVENTION

Figure 1:
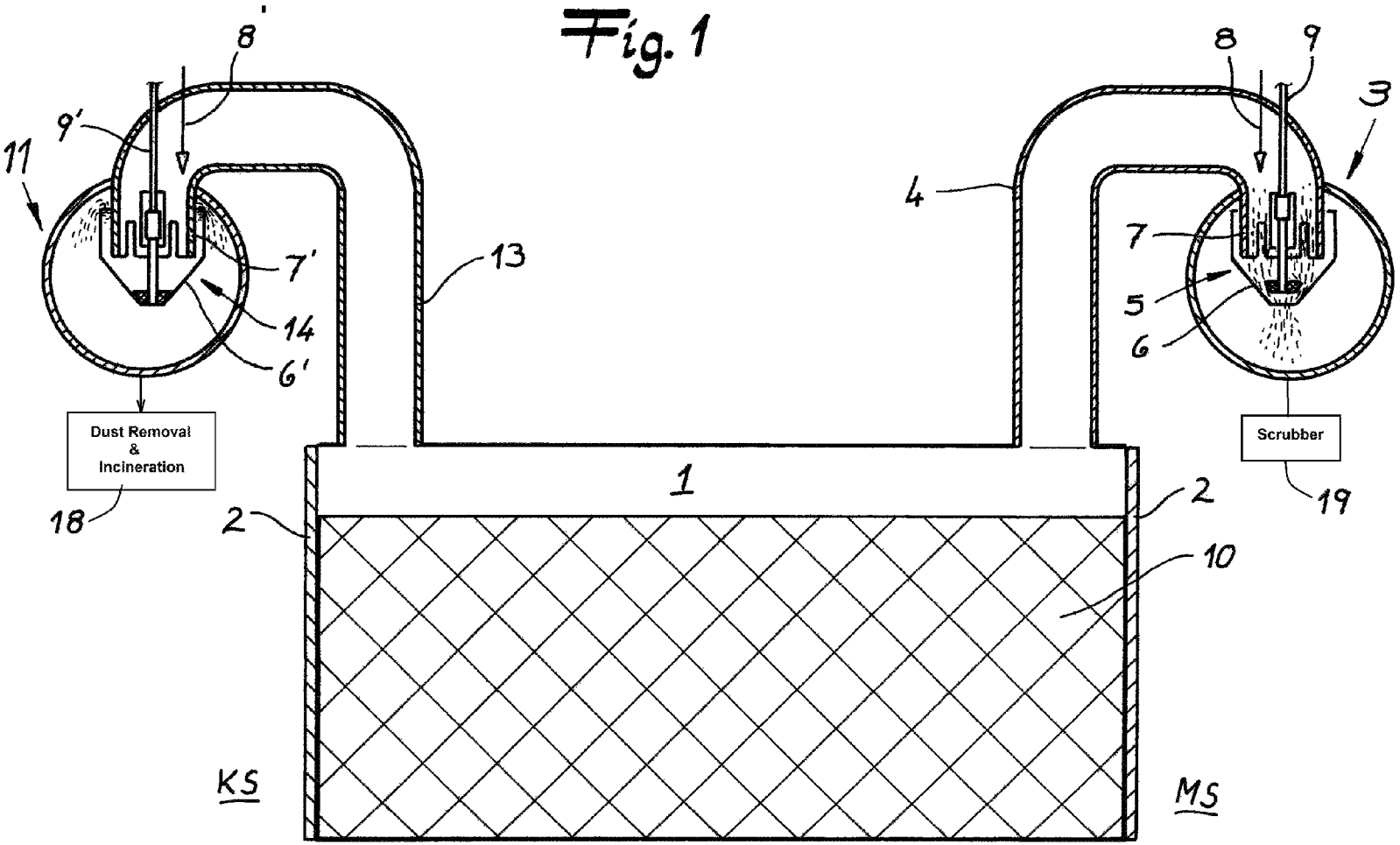
FIG. 1 is a longitudinal section of an oven chamber of a battery of coke ovens.

The oven chamber 1 shown in the drawing is part of a battery of coke ovens in a row in succession one next to the other. The oven chambers 1 are each provided with a door 2 on the machine side MS and also on the coke side KS. The machine side MS is the side of the battery of coke ovens where there is a pusher machine that not shown in FIG. 1 and that can move longitudinally along the battery of coke ovens. The pusher machine pushes out the finished coke formed by coking action in an environment from which air is excluded, for further processing. The coke side KS is that side of the battery of coke ovens where the coke falls out of the oven chambers when it is done and into a quenching car with the aid of a transfer machine.

A crude-gas manifold 3 is provided for the discharge of crude gases formed during the coking process in the closed oven chambers. It extends as a collecting pipe longitudinally along the battery of coke ovens and is connected to the oven chambers of the battery of coke ovens by respective conduits 4. The conduits 4 each have a flow blocker 5 having in the embodiment of FIG. 1 a water-filled dip cup 6, as well as a dip pipe 7 connected to the gas-carrying conduit 4. The dip cup 6 is supplied with water by a feed pipe 8. Also provided is a device 9 for controlling the liquid level in the dip cup 6 and for thereby opening or blocking the gas path. Using the shown device, individual control of the pressure in the oven chambers 1 is also possible. Temperature-resistant elements, with and without water-immersion, can also be used as control organs for maintaining certain pressure values in the oven chambers.

The oven chambers 1 of the battery of coke ovens are charged with compressed-coal blocks 10 that are each introduced by the pusher machine into one of the opened oven chambers from the machine side MS. Byproduct gases having a temperature of about 1000° C. are released during introduction of the compressed-coal blocks into the oven chamber 10 and pass into a byproduct-gas manifold 11 connected to the oven chamber 1, then preferably freed of dust and incinerated in a stationary system shown schematically at 18. In the embodiment in FIG. 1, the byproduct-gas manifold 11 extends longitudinally as a collecting pipe along the battery of coke ovens, and is connected to the oven chambers 1 of the battery of coke ovens via conduits 13 each having a flow blocker 14. The flow blockers 14 of the byproduct-gas manifolds 11 are water-immersion means 6', 7' that can be opened and closed by a device 9' from the outside. Instead of flow blockers 14 as shown in FIG. 1, it is also possible to use blocking means that are configured as a damper or slide and that have a temperature-resistant blocking element.

The flow blockers 14 or 5 that are connected to the byproduct-gas manifold 11 and to the crude-gas manifold 3 are alternately actuated, such that the byproduct gases that form during charging of an oven chamber are only conducted to the byproduct-gas manifold 11, and the crude gases that form during the coking process inside the closed oven chambers are only conducted to the crude-gas manifold 3. The crude gases are supplied to a gas treatment process via the crude-gas manifold 3 while byproducts are formed. The gas treatment comprises at least one gas scrubber shown schematically at 19. The byproduct gases that are separately discharged by the byproduct-gas manifold 11 are, preferably, freed of dust and incinerated, the use of the stationary dust removal device 18 being possible for the dust removal as well for detecting the emissions generated during the coke-pushing operation. It is understood that a separate dust removal apparatus can also be used for removing dust from the byproduct gases.

FIG. 1 is a longitudinal section through a closed oven chamber 1 of the battery of coke ovens. The flow blocker 5 of the crude-gas manifold 3 is open, such that gases that formed during the coking process can be discharged through the crude-gas manifold 3. The flow blocker 14 of the byproduct-gas manifold 11, on the other hand, is closed, such that no crude gases can get into the byproduct-gas manifold.

Figure 2:
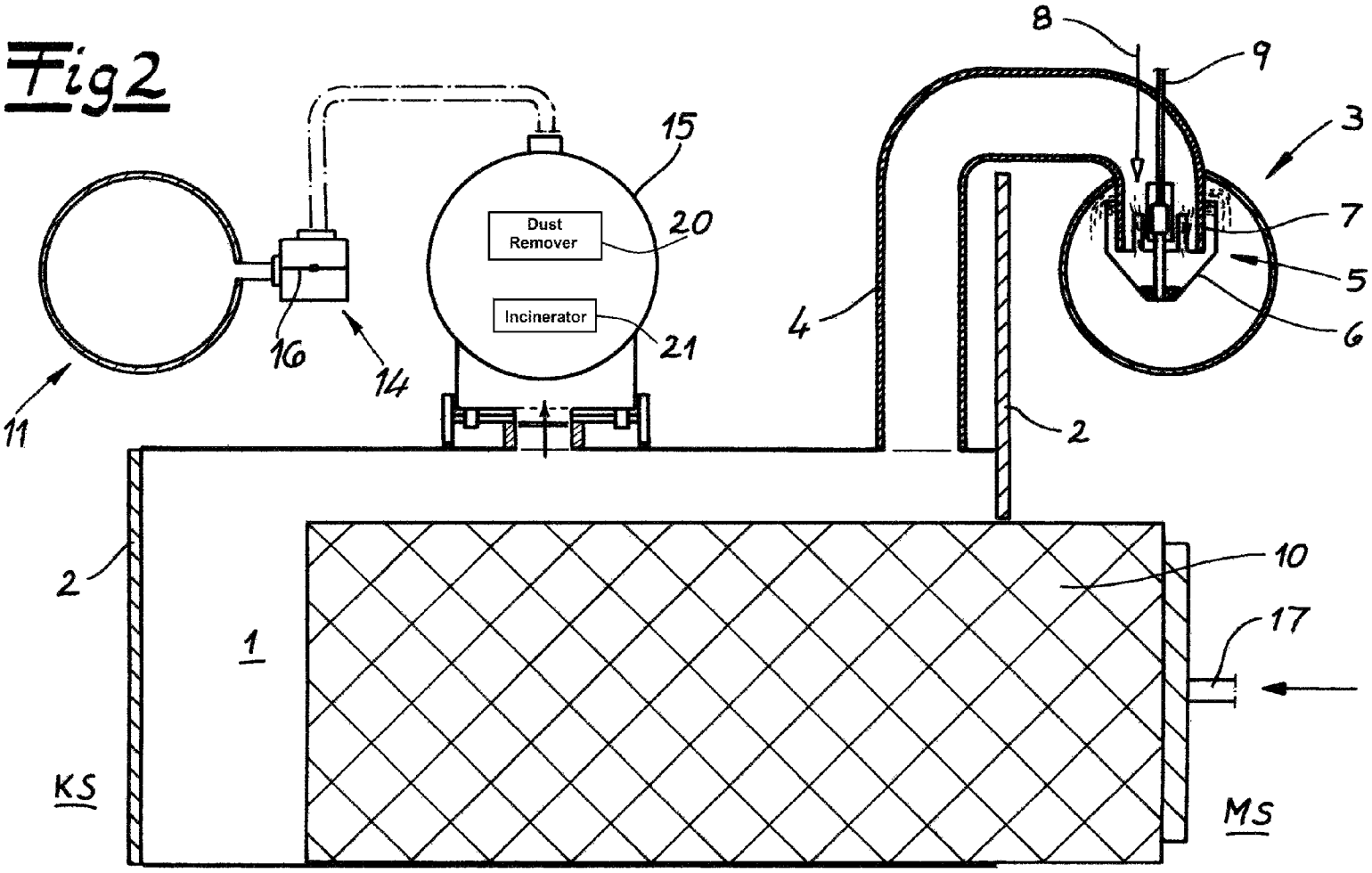
FIG. 2 is another embodiment, also shown in longitudinal section of the oven chamber of a battery of coke ovens.

FIG. 2 shows a longitudinal section of an oven chamber 1 during the charging action with a block of compressed coal 10. The block of compressed coal 10 is introduced by a pusher machine 17 through the door 2 that is open on the machine side MS, and into the oven chamber 1. Byproduct gases released during this step are discharged by the separate byproduct-gas manifold 11, subsequently freed of dust and incinerated. The flow blocker 5 of the crude-gas manifold 3 is closed so no byproduct gases are able to enter the crude-gas manifold 3. The embodiment in FIG. 2 shows how the byproduct-gas manifold 11 of the opened oven chamber 1 is attached to a byproduct-gas aspirating car 15 for aspirating the byproduct gases. The byproduct-gas aspirating car 15 is able to travel longitudinally along the battery of coke ovens and is preferably installed on a track on the ceiling of the battery of coke ovens. To block the conduit that links the oven chamber 1 with the byproduct-gas manifold 11, the embodiment in FIG. 2 has a flow blocker 14 with a temperature-resistant blocking element 16 in the form of a blocking damper or slide. The car 15 is schematically shown holding a device 20 for dust removal and an incinerator 21 for burning the byproduct gases.

The invention claimed is:

1. A method of reducing byproduct-gas emissions when charging hot oven chambers of a coke-oven battery with compressed-coal blocks, the method comprising the steps of:

opening the hot oven chamber to be charged on the machine side of the battery and introducing a block of compressed coal into the opened oven chamber such that byproduct gases are released, conducting the byproduct gases released in the open chamber and during the introduction of the block of compressed coal into the hot oven chamber to a byproduct-gas manifold connected to the open chamber while preventing introduction of the byproduct gas into a crude-gas manifold connected to the chamber, withdrawing the byproduct gases from the byproduct-gas manifold and removing dust from and incinerating the withdrawn byproduct gases, thereafter closing the hot chamber, coking the block in the hot chamber, and thereby forming crude gas, conducting crude gases formed during coking inside the closed oven chamber through the crude-gas manifold separate from the byproduct-gas manifold to a gas-treatment system that has at least a gas scrubber while preventing introduction of the crude gases into the byproduct-gas manifold.

2. The method according to claim 1, wherein the byproduct gases are aspirated into the byproduct-gas manifold by pressure control in the byproduct-gas manifold.

3. The method according to claim 1, wherein the byproduct gases are dedusted in to a stationary dust removal station.

4. The method according to claim 1, wherein the byproduct-gas manifold is connected to a byproduct-gas aspirating car that is able to travel along the battery for aspirating the byproduct gases.

5. The method according to claim 1, wherein blocking dampers and slides with temperature-resistant blocking elements are used for closing the conduits that connect the oven chambers to the byproduct-gas manifold.

6. The method according to claim 1, wherein the byproduct-gas manifold extends as a collecting pipe along the battery of coke oven chambers and is connected by respective conduits with flow blockers to the oven chambers of the battery, the flow blockers being water-immersion means that are opened or closed from the outside in order to open or block the gas path.

7. The method according to claim 1, further comprising the step of:

individually controlling the pressures inside the closed coke oven chambers during coking.

8. The method according to claim 7, wherein the crude-gas manifold extends as a collecting pipe along the battery of coke oven chambers and is connected by respective conduits with flow blockers to the oven chambers of the battery, the flow blockers each have a water-filled dip cup as well as a dip pipe connected to the gas-carrying conduit, the fluid level within the dip cup is controlled, and the gas path is thereby opened and blocked.

9. The method according to claim 1, wherein control organs made of temperature-resistant elements are used with or without water immersion in order to maintain predetermined pressure values inside the oven chambers.

10. A method of operating a coke-oven battery having a hot coking chamber with at least one closable door through which a compressed-coal block can be passed, a closable connection to a crude-gas manifold, and a closable connection to a byproducts-gas manifold, the method comprising the steps of:

opening the door of the chamber and pushing a compressed-coal block into the chamber such that the block and ambient oxygen together create byproduct gases in the chamber;

while the door is opened, aspirating the byproduct gases from the chamber into the byproduct-gas manifold while preventing the byproduct gases from entering the crude-gas manifold;

withdrawing the aspirated byproduct gases from the byproduct-gas manifold and dedusting and combusting the withdrawn byproduct gases;

closing the door when the block is inside the chamber such that oxygen no longer is admitted into the chamber;

thereafter coking the block in the chamber to generate crude gas while aspirating the crude gas into the crude-gas manifold and preventing the crude gas from entering the byproduct-gas manifold; and withdrawing the aspirated crude gas from the crude-gas manifold and scrubbing the withdrawn crude gas.

11. A coke-oven battery comprising:

a plurality of hot oven chambers arrayed next to each other and having doors on a machine side and on a coke side, a pusher machine movable on the machine side along the battery, and a crude-gas manifold for discharging crude gases that form during coking inside the closed oven chambers, means for introducing a block of compressed coal by the pusher machine into an oven chamber that is open on the machine side, and after the coking process for removing coke from the oven chamber that is open on the coke side, a separate byproduct-gas manifold for the discharge of byproduct gases released during the introduction of the compressed-coal blocks into the hot oven chamber, and flow blockers connecting the byproduct-gas manifold and the crude-gas manifold to the oven chamber and to the byproduct-gas manifold and the crude-gas manifold, the flow blockers being alternately actuated such that the byproduct gases that form when charging the oven chambers are only conducted to the byproduct-gas manifold and not to the crude-gas manifold and the gas-treatment system and the crude gases that form for during the coking action inside the closed oven chambers are only conducted to the crude-gas manifold; and means connected to the byproduct-gas manifold for removing dust from and incinerating the byproduct gases.

12. The cokeoven battery according to claim 11, wherein the means connected to the byproduct-gas manifold is a byproduct-gas aspirating car for aspirating the byproduct gases that travels along the battery of coke ovens and that can be connected to the byproduct-gas manifold of an oven chamber to be charged with coal.

13. The battery of coke ovens according to claim 12, wherein the byproduct-gas aspirating car has a combustion chamber for incinerating the byproduct gases.

14. The battery of coke ovens according to claim 11, wherein the flow blocker of the byproduct-gas manifold is configured as a blocking damper or slider and has a temperature-resistant blocking element.

15. The battery of coke ovens according to claim 11, wherein the byproduct-gas manifold extends as a collecting pipe along the battery of coke ovens and is connected via respective conduits with flow blockers to the oven chambers of the coke oven batteries, the flow blockers having water-immersion means that can be opened and closed from the outside in order to free or block gas flow.

16. The battery of coke ovens according to claim 11, wherein the byproduct-gas manifold extends along the battery of coke ovens on the coke side, and the crude-gas manifold extends along the battery of coke ovens on the machine side.

17. The battery of coke ovens according to claim 11, wherein the byproduct-gas manifold extends along the battery of coke ovens on the machine side, and the crude-gas manifold extends along the battery of coke ovens on the coke side.

18. The battery of coke ovens according to claim 11, further comprising:

an arrangement made up of the byproduct-gas manifold and the crude-gas manifold is disposed as a system component either on the machine side or the coke side of the battery of coke ovens.

* * * * *